US011525172B1

(12) United States Patent
Qiao et al.

(10) Patent No.: US 11,525,172 B1
(45) Date of Patent: Dec. 13, 2022

(54) NICKEL-NIOBIUM INTERMETALLIC ALLOY USEFUL FOR VALVE SEAT INSERTS

(71) Applicant: L.E. Jones Company, Menominee, MI (US)

(72) Inventors: Cong Yue Qiao, Menominee, MI (US); David M. Doll, Fort Worth, TX (US)

(73) Assignee: L.E. Jones Company, Menominee, MI (US)

( * ) Notice: Subject to any disclaimer, the term of this patent is extended or adjusted under 35 U.S.C. 154(b) by 0 days.

(21) Appl. No.: 17/539,614

(22) Filed: Dec. 1, 2021

(51) Int. Cl.
*C22C 19/05* (2006.01)
*F01L 3/02* (2006.01)

(52) U.S. Cl.
CPC ..... *C22C 19/058* (2013.01); *F01L 3/02* (2013.01)

(58) Field of Classification Search
None
See application file for complete search history.

(56) References Cited

U.S. PATENT DOCUMENTS

| | | | |
|---|---|---|---|
| 3,069,258 | A | 7/1959 | Haynes |
| 3,390,023 | A | 6/1968 | Shira et al. |
| 3,554,817 | A | 1/1971 | Thompson |
| 3,767,479 | A | 10/1973 | Tarshis |
| 3,793,010 | A | 2/1974 | Lemkey et al. |
| 3,837,933 | A | 9/1974 | Masumoto et al. |
| 4,119,458 | A | 10/1978 | Moore |
| 4,488,259 | A | 12/1984 | Mercy |
| 4,556,534 | A | 12/1985 | Burnett et al. |
| 4,585,620 | A | 4/1986 | Kamohara et al. |
| 4,626,408 | A | 12/1986 | Osozawa et al. |
| 4,710,243 | A | 12/1987 | Masumoto et al. |

(Continued)

FOREIGN PATENT DOCUMENTS

| | | |
|---|---|---|
| CA | 2688507 | 6/2011 |
| CA | 2688647 | 6/2011 |

(Continued)

OTHER PUBLICATIONS

English language machine translation of JP-2003136279-A. Generated Sep. 21, 2022. (Year: 2022).*

(Continued)

*Primary Examiner* — Brian D Walck
(74) *Attorney, Agent, or Firm* — Buchanan Ingersoll & Rooney PC

(57) ABSTRACT

A nickel-niobium intermetallic alloy contains, in weight percent, silicon from about 1.5 to about 3.5 percent; chromium from 5 to about 15 percent; nickel from about 45 to about 75 percent; niobium from about 14 to about 30 percent; cobalt up to about 7 percent; and iron up to about 10 percent; wherein the nickel plus niobium content is about 70 to about 90 percent and the total silicon, chromium, cobalt and iron content is about 10 to about 30 percent. The alloy can have a cast microstructure of at least 95 volume percent intermetallic phases and no more than about 5 volume percent solid solution phases. The intermetallic phases can include rod-like intermetallic phases of $Ni_3Nb$ and $Ni_8Nb_7$. The microstructure can be a lamellar microstructure and/or the microstructure can have less than 5 volume percent Ni—Fe and Ni—Co rich intermetallic phases.

20 Claims, 11 Drawing Sheets

(56) References Cited

U.S. PATENT DOCUMENTS

| | | | |
|---|---|---|---|
| 4,749,546 | A | 6/1988 | Burley |
| 4,833,864 | A | 5/1989 | Schnippering et al. |
| 4,836,849 | A | 6/1989 | Svedberg et al. |
| 5,059,259 | A | 10/1991 | Nazmy et al. |
| 5,282,907 | A | 2/1994 | Liu et al. |
| 5,496,419 | A | 3/1996 | Murakami et al. |
| 5,725,687 | A | 3/1998 | Murakami et al. |
| 5,820,700 | A | 10/1998 | DeLuca et al. |
| 6,342,181 | B1 | 1/2002 | Newkirk et al. |
| 6,482,275 | B1 | 11/2002 | Qiao |
| 6,730,264 | B2 | 5/2004 | Cao |
| 8,608,877 | B2 | 12/2013 | DiDomizio et al. |
| 8,613,886 | B2 | 12/2013 | Qiao et al. |
| 8,858,874 | B2 | 10/2014 | Tin et al. |
| 8,906,174 | B2 | 12/2014 | Imano et al. |
| 9,074,476 | B2 | 7/2015 | Hardy |
| 9,828,658 | B2 | 11/2017 | Helmink |
| 9,938,610 | B2 | 4/2018 | Helmink et al. |
| 2009/0081073 | A1 | 3/2009 | Barbosa et al. |
| 2009/0081074 | A1 | 3/2009 | Barbosa et al. |
| 2009/0196760 | A1* | 8/2009 | Harada ..... C22C 19/057 420/443 |

FOREIGN PATENT DOCUMENTS

| | | | | |
|---|---|---|---|---|
| DE | 2164889 | A1 | | 7/1973 |
| DE | 2720197 | A1 | | 11/1978 |
| EP | 0751230 | A1 | | 2/1997 |
| JP | H10237609 | A | | 9/1998 |
| JP | 2003136279 | A | * | 5/2003 |
| JP | 2006-299410 | A | | 11/2006 |
| WO | WO201129164 | A1 | | 3/2011 |
| WO | WO201129165 | A1 | | 3/2011 |

OTHER PUBLICATIONS

Kriege et al., "The Chemical Partitioning of Elements in Gamma Prime Separated From Precipitation-Hardened, High-Temperature Nickel-Base Alloys", American Society for Metals, Transactions of the ASM, vol. 62, No. 1, Mar. 1969, pp. 195-200.

Shang et al., "Microstructure and Mechanical Properties of a New Nickel-Based Single Crystal Superalloy", Journal of Materials Research and Technology (JMR&T), Elsevier, 2020, 9(5), pp. 11641-11649.

* cited by examiner

| Element | Weight % | Atomic % |
|---|---|---|
| C K | 7.15 | 26.74 |
| O K | 0.74 | 2.07 |
| SiK | 9.61 | 15.36 |
| NbL | 26.82 | 12.96 |
| CrK | 2.14 | 1.85 |
| FeK | 1.68 | 1.35 |
| CoK | 3.13 | 2.39 |
| NiK | 48.73 | 37.28 |

| Element | Weight % | Atomic % |
|---|---|---|
| C K | 4.77 | 19.04 |
| O K | 1.28 | 3.85 |
| SiK | 0.53 | 0.90 |
| NbL | 8.16 | 4.21 |
| CrK | 18.14 | 16.74 |
| FeK | 10.02 | 8.61 |
| CoK | 5.14 | 4.18 |
| NiK | 51.97 | 42.47 |

| Element | Weight % | Atomic % |
|---|---|---|
| C K | 2.15 | 9.41 |
| O K | 1.52 | 5.01 |
| SiK | 0.21 | 0.40 |
| NbL | 13.34 | 7.56 |
| CrK | 26.12 | 26.45 |
| FeK | 8.53 | 8.04 |
| CoK | 4.58 | 4.09 |
| NiK | 43.55 | 39.04 |

NICKEL-NIOBIUM INTERMETALLIC ALLOY USEFUL FOR VALVE SEAT INSERTS

BACKGROUND

Many engine components are required to possess elevated temperature wear resistance, corrosion resistance, and thermal shock resistance such as valve seat insert (VSI), valve, valve guide, turbo bushing, and turbo shaft. Conventionally, martensitic tool steels, primary carbide strengthened nickel (e. g. J96) or cobalt matrix alloy (J6), and partial intermetallic matrix (J10) are used for these applications.

SUMMARY

Disclosed herein is a nickel-niobium intermetallic alloy containing, in weight percent, silicon from about 1.5 to about 3.5 percent; chromium from 5 to about 15 percent; nickel from about 45 to about 75 percent; niobium from about 14 to about 30 percent; cobalt up to about 7 percent; and iron up to about 10 percent; wherein the nickel plus niobium content is about 70 to about 90 percent and the total silicon, chromium, cobalt and iron content is about 10 to about 30 percent.

According to various optional embodiments, the alloy may contain up to 3 percent total other elements and unavoidable or incidental impurities including carbon, manganese, phosphorus, sulfur, copper, nitrogen, oxygen, boron, tungsten, molybdenum, vanadium, tantalum, titanium, hafnium, zirconium, beryllium, bismuth, aluminum, calcium, lead, selenium, yttrium, rare earth metals.

In an embodiment, the alloy can consist essentially of about 1.75 to about 3 percent silicon, about 7 to about 15 percent chromium, up to about 6.5 percent cobalt, about 0.05 to about 10 percent iron, about 14 to about 29 percent niobium, about 48 to about 73 percent nickel, and balance up to 3 percent other elements and incidental or unavoidable impurities. In an embodiment, nickel, cobalt, niobium and chromium can be added such that the ratio of nickel plus cobalt to niobium plus chromium is about 1.5 to about 3.

In an embodiment, a valve seat insert useful in a combustion engine can be made of the alloy described above. For example, a casting, such as a cast valve seat insert, made of the alloy and the alloy can have an as-cast microstructure of at least 95 volume percent intermetallic phases and no more than about 5 volume percent solid solution phases. The intermetallic phases can include rod-like intermetallic phases of $Ni_3Nb$ and $Ni_8Nb_7$. The microstructure can be a lamellar microstructure and/or the microstructure can have less than 5 volume percent Ni—Fe and Ni—Co rich intermetallic phases.

A casting of the alloy can be made by forming a melt of the alloy, pouring the melt into a mold and cooling the melt to form the casting. During cooling, the melt can be solidified into a microstructure of at least 95 volume percent intermetallic phases with a uniform microstructure. In an embodiment, the melt can consist essentially of about 1.75 to about 3 percent silicon, about 7 to about 15 percent chromium, up to about 6.5 percent cobalt, about 0.05 to about 10 percent iron, about 14 to about 29 percent niobium, about 48 to about 73 percent nickel, and balance up to 3 percent total other elements and incidental or unavoidable impurities, the alloy having a total nickel plus niobium content of about 70 to about 90 percent and a total silicon, chromium, cobalt and iron content of about 10 to about 30 percent.

DETAILED DESCRIPTION

Figure 1:
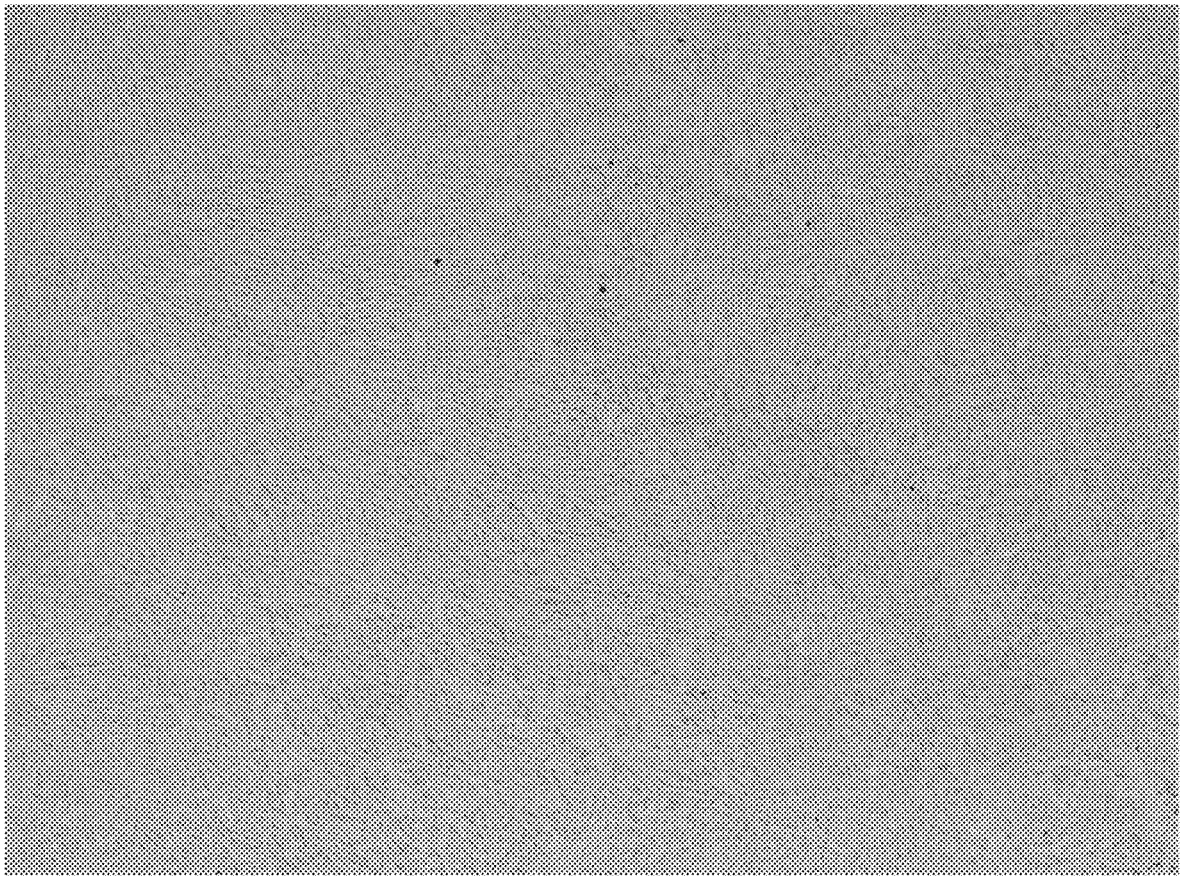
FIG. 1 shows a Backscattered Electron Image of Jonesite 19 at 100×.

In an effort to improve alloys suitable for high temperature applications, an alloy comprised of intermetallic phases has been developed which has potential for a variety of engineering applications. For instance, the alloy may exhibit sustained or even improved material strength at elevated temperatures. In an embodiment, the alloy chemistry can be designed such that two different intermetallic phases are constituted as base "components." In examples provided below, the alloy is referred to as "Jonesite 19" which is a $Ni_3Nb$—$Ni_8Nb_7$ alloy exhibiting desirable high temperature properties intended for the intermetallic composite alloy design. Jonesite 19 may be a particularly good alloy for use in hydrogen fuel internal combustion engines in which the combustion byproduct is mainly water. In such engines, a high corrosion resistance intermetallic alloy is potentially more suitable for VSI/valve applications.

Although hydrogen internal combustion engines (HICE) have been explored since the early nineteenth century, to date such engines have not been in common use for passenger vehicles. In recent years, a renewed interest of HICE for transportation applications is partially due to its lower combustion emissions compared to gasoline IC engines. Essentially, no carbon emission is formed from the combustion of $2H_2+O_2=2H_2O$ reaction. For a typical HICE engine design, oxygen gas is in-taken from air which also introduces nitrogen into the combustion reaction. As a result, a small amount of $NO_x$ can form which the actual amount of $NO_x$ formed in a HICE engine is a function of hydrogen to air ratio.

Hydrogen flames have a smaller quenching distance compared to gasoline flames and thus can travel closer to the cylinder wall including the valve/VSI position than other fuels. In addition, the combustion byproducts of the HICE engine are very different from gasoline or diesel fueled engines. Thus, different requirements for corrosion and wear resistance of VSI/valve alloys are needed for HICE engines than gas/diesel engines. Intermetallic based alloy products with good dry wear condition are potentially good candidates to achieve desired high performance for valve train components. Several L. E. Jones ("LEJ") intermetallic alloy products are available which can be adopted to assist HICE or HICE+Natural gas engines for meeting their desired performance.

Modern internal combustion engines are operated under substantially higher temperature and pressure conditions to comply with the more stringent emission regulations adopted more than two decades ago. Under the ever-increased operational temperature and stress conditions, conventional valve seat insert (VSI) alloys with a high percentage of solid solution strengthening phase matrix can no longer meet the engine valve train component performance needs. A new high-performance alloy, LEJ alloy J513, is an iron-rich alloy with a primary intermetallic phase strengthening mechanism. The excellent performance of alloy J513 in valve train applications confirms the effectiveness of high-volume intermetallic phase strengthening mechanisms in alloys employed for engine component applications. For J513, the primary intermetallic phase, σ phase is formed through solid state phase transformation. In contrast, the primary intermetallic phases matrix of Jonesite 19 is achieved through an alloy solidification process. More specifically, two different types of intermetallic phases can be formed through a desired eutectic reaction during solidification.

Another concept adopted for the modern VSI alloy designs is to achieve finely distributed microstructures. Compared to LEJ alloy J10 in which Laves intermetallic phases are alternatively distributed in its microstructure typically in a patchy morphology, J513 possesses a finely distributed σ intermetallic phase in its microstructure that has contributed to a better and more consistent tribo performance. In contrast to commercial super alloys such as Inconel 718 for which a small amount of intermetallic phase is used to strengthening the "softer" matrix, about 50% of the matrix in J513 and J10 contain a significant amount of single-phase intermetallic compound. However, both J513 and J10 still have a "softer" matrix portion which limits the temperature and working stress level that can be required for elevated temperature services. In general, J513 possesses a somewhat better elevated temperature performance than J10 primarily due to its finely and evenly distributed microstructure (matrix phase and intermetallic strengthening phase) in J513 compared to J10.

The Jonesite 19 alloy preferably contains primarily two intermetallic matrix phases with a very small amount of solid solution phase (less than 5 vol. %) and a finely distributed microstructure. In general, Jonesite 19 can include 70 to 90 wt. % total Ni and Nb, 10 to 30 wt. % total Si, Cr, Co and Fe, and less than 3% total other elements including incidental or unavoidable impurities. In a specific example, the Jonesite 19 alloy can be a niobium and nickel intermetallic system with a total amount of niobium plus nickel of approximately 75 wt. % while the remaining 25 wt. % of the elements include chromium, cobalt, iron, and silicon. More generally, Jonesite 19 can include an amount of chromium (Cr) targeted at about 5 to 15 wt. % (5, 6, 7, 8, 9, 10, 11, 12, 13, 14, 15 wt. % or any range therebetween) to provide superior corrosion resistance, iron (Fe) targeted at up to 10 wt. % Fe (0, 1, 2, 3, 4, 5, 6, 7, 8, 9, 10 wt. % Fe or any range therebetween), cobalt (Co) targeted at up to about 7 wt. % Co (0, 1, 2, 3, 4, 5, 6, 7 wt. % Co or any range therebetween) and silicon (Si) targeted at about 1.5 to 3.5 wt. % Si (1.5, 2, 2.5, 3, 3.5 wt. % Si or any range therebetween). The amounts of iron and cobalt can be selected to ensure no significant iron-nickel or cobalt-nickel type of intermetallic phase formation in the Jonesite 19 alloy system but ensure desired phase formation in inter primary eutectic reactants region. Jonesite 19 preferably includes less than 3 wt. % total other elements including incidental or unavoidable impurities which include at least carbon (C), manganese (Mn), molybdenum (Mo), tungsten (W) and vanadium (V) are less than 0.1 wt. % C, less than 0.1 wt. % Mn, less than 0.4 wt. % Mo, less than 0.3 wt. % W and less than 0.3 wt. % V. Optionally, a ratio of total nickel plus cobalt to total niobium plus chromium is about 1.5 to about 3.

The material properties of intermetallic phases can be significantly varied dependent upon the type of intermetallic. For instance, the primary intermetallic phase in alloy J10 is Laves phase which has an $AB_2$ stoichiometry. However, intermetallic phases typically exhibit high strength but low ductility and thus have a relatively low impact rupture resistance. In order to obtain sufficient impact rupture (cracking) resistance, the J10 alloy consists of approximate 50 wt. % of Laves phase and 50 wt. % of cobalt solid solution phase. The soft cobalt solid solution phase and Laves phase are alternatively distributed to achieve a balanced strength and ductility.

The matrix formation of Jonesite 19 is via a mid-compositional range eutectic reaction for which hypereutectic has been selected. This is a novel alloy development concept compared to commercially available high alloys designed with binary or ternary system with two or three elements. Jonesite 19 is designed with two intermetallic phases $Ni_3Nb$ and $Ni_8Nb_7$ as the basis with which the eutectic reaction takes place and can be considered a fully intermetallic phase alloy. With this alloy system, the eutectic reaction occurs at approximately 2150° F. which is within an ideal casting process range with common metal melting methodologies. At the same time, two intermetallic phases eutectic reactants exhibit a melting temperature at approximately 2550° F. and 2359° F., respectively. Thus, the service temperature capability for Jonesite 19 is substantially higher than conventionally designed high alloy systems but with a casting temperature within a similar temperature range as used for conventionally designed high alloys. Multiple component intermetallic phase alloys, in general, exhibit a high potential phase stability at elevated temperature owing to low Gibb's free energy of such alloy systems.

The Jonesite 19 alloy system can provide a mixed intermetallic phase structure through eutectic reaction and the alloy system will be stable with even lower Gibb's free energy. At the same time, the bonding strength between $Ni_3Nb$ and $Ni_8Nb_7$ should be desirably high due to crystallographic similarity.

Table 1 provides exemplary Jonesite 19 alloy compositions in wt. % and predicted hardness in HRc (the balance of the alloy compositions listed in Table 1 are incidental and unavoidable impurities).

TABLE 1

| Heat | C | Mn | Si | Cr | Co | Fe | Nb | Ni | Ni/Nb | Ni + Nb | HRc |
|---|---|---|---|---|---|---|---|---|---|---|---|
| 1 | 0.02 | 0.023 | 2.76 | 8.1 | 0.16 | 0.06 | 15.9 | 72.3 | 4.5 | 88.2 | 43.5 |
| 2 | 0.022 | 0.018 | 2.86 | 14.9 | 0.01 | 0.09 | 14.1 | 67.4 | 4.8 | 81.5 | 48.5 |

TABLE 1-continued

| Heat | C | Mn | Si | Cr | Co | Fe | Nb | Ni | Ni/Nb | Ni + Nb | HRc |
|---|---|---|---|---|---|---|---|---|---|---|---|
| 3 | 0.017 | 0.015 | 2.49 | 10 | 4.86 | 0.15 | 26.6 | 55.5 | 2.1 | 82 | 40.9 |
| 4 | 0.018 | 0.025 | 3 | 11.1 | 6.24 | 0.06 | 26.6 | 69.2 | 2.6 | 95.8 | 26.3 |
| 5 | 0.02 | 0.025 | 2.84 | 10.7 | 6.06 | 0.07 | 2.2 | 67.1 | 2.6 | 93.3 | 26.3 |
| 6 | 0.021 | 0.028 | 2.71 | 10.3 | 5.93 | 0.08 | 12.6 | 65 | 5.2 | 77.6 | 31.5 |
| 7 | 0.024 | 0.03 | 2.6 | 9.7 | 5.79 | 0.11 | 15.1 | 62.7 | 4.2 | 77.8 | 46.5 |
| 8 | 0.029 | 0.03 | 2.4 | 9 | 5.29 | 0.15 | 18.1 | 57.7 | 3.2 | 70.8 | 40.4 |
| 9 | 0.07 | 0.052 | 1.98 | 10.2 | 5.26 | 6.94 | 25.3 | 48 | 1.9 | 73.3 | 54 |
| 10 | 0.034 | 0.034 | 2.57 | 9.3 | 5.51 | 1.4 | 26.5 | 60.4 | 2.3 | 86.9 | 46.4 |
| 11 | 0.036 | 0.036 | 2.49 | 9.2 | 5.47 | 1.97 | 19.8 | 60.1 | 3 | 79.9 | 50.2 |
| 12 | 0.038 | 0.039 | 2.47 | 9.1 | 5.37 | 2.4 | 19.6 | 59.7 | 3 | 79.3 | 50.5 |
| 13 | 0.02 | 0.029 | 1.93 | 7.2 | 4.72 | 2.4 | 28.9 | 52.3 | 1.8 | 81.2 | 57 |
| 14 | 0.052 | 0.04 | 2.12 | 7.5 | 0.01 | 2.06 | 23.7 | 63.5 | 2.7 | 87.2 | 47.1 |
| 15 | 0.05 | 0.195 | 2.74 | 13.36 | 0.149 | 9.56 | 21.53 | 51 | 2.4 | 72.53 | 47.4 |
| 16 | 0.076 | 0.05 | 2.21 | 9.82 | 5.49 | 3.48 | 26.64 | 51 | 1.91 | 77.04 | 52.6 |
| 17 | 0.039 | 0.053 | 2.19 | 9.65 | 5.38 | 3.01 | 27.8 | 50.1 | 1.8 | 77.9 | 55 |
| 18 | 0.078 | 0.046 | 1.98 | 9.35 | 5.35 | 5.25 | 27.62 | 48.4 | 1.75 | 76.02 | 55.9 |
| 19 | 0.07 | 0.025 | 2.1 | 9.81 | 5.45 | 5.31 | 24.89 | 50.6 | 2.03 | 75.49 | 53.5 |

FIG. 1 shows a typical general microstructural distribution in a cast structure of Jonesite 19 (Heat 9) which exhibits a very fine microstructural distribution. The Jonesite 19 alloy exhibited a strong corrosion resistance and in fact is difficult to be properly etched for metallographic examination. Therefore, a backscattered electron image was applied to reveal the microstructural details.

Figure 2:
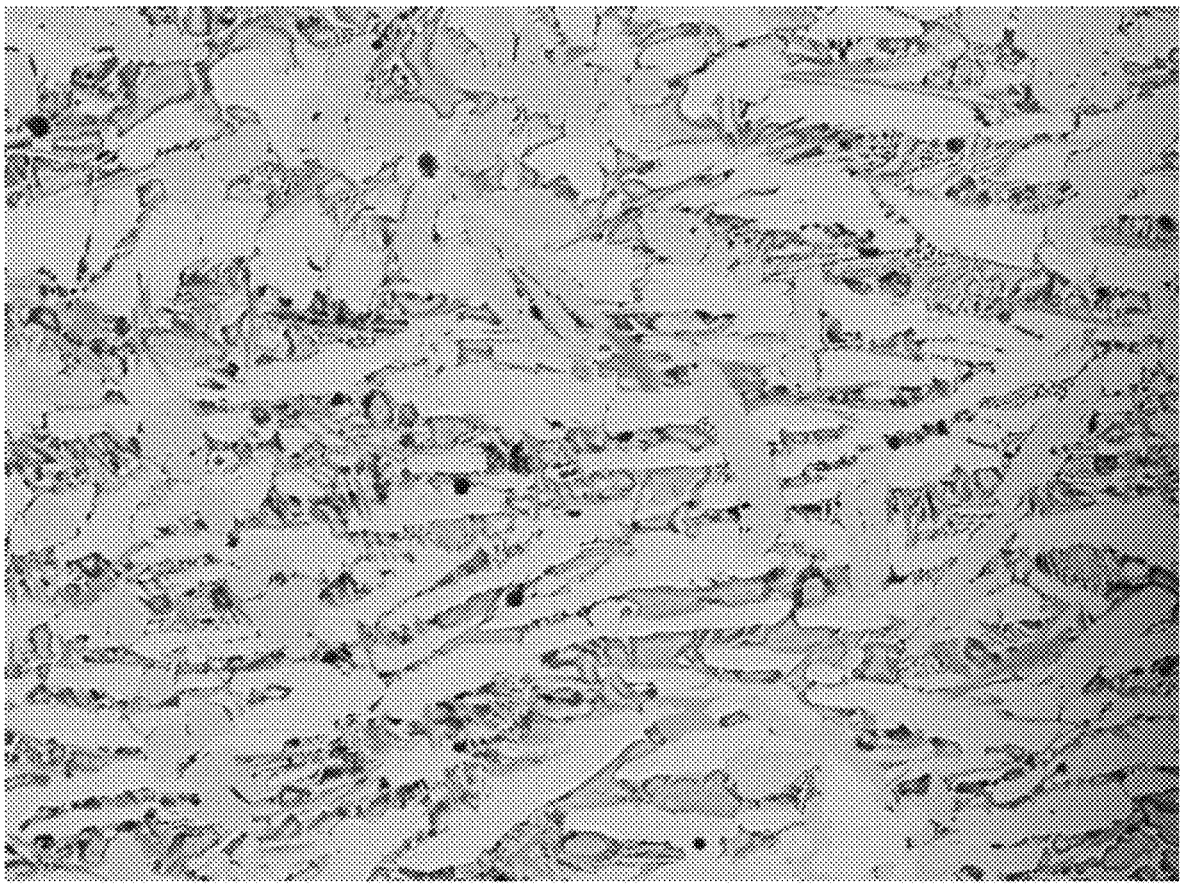
FIG. 2 shows a backscattered electron image of Jonesite 19 at 1500×.

FIG. 2 show a microstructural image of Jonesite 19 at high magnification. Apparently, intermetallic and intermetallic eutectic reactants were achieved along with very small portion of inter-eutectic region phase (fine eutectic reactants in nature, primarily)

Figure 3:
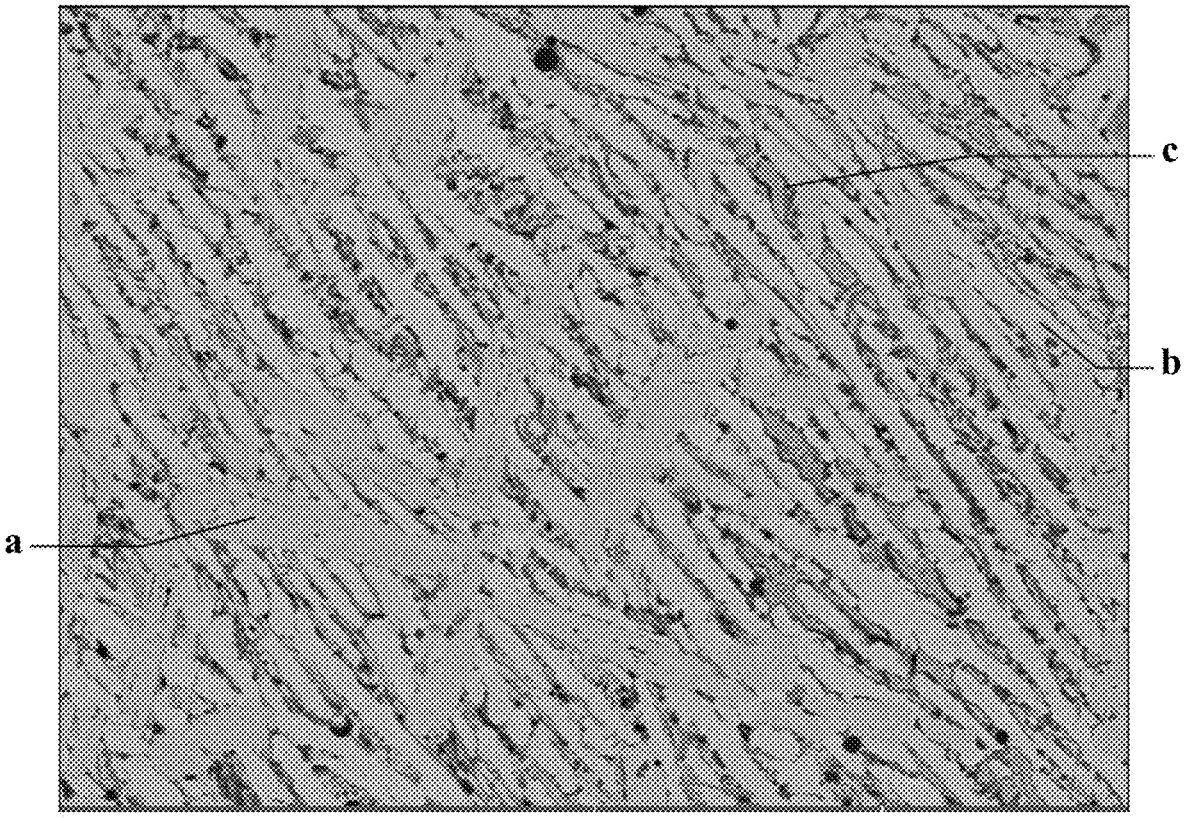
FIG. 3 shows eutectic reactants images and three potential different eutectic reactants at 1500×.

FIG. 3 shows another typical Jonesite 19 microstructure with three different z-contrast reactant phases labeled as a, b, and c, respectively.

Figure 4:
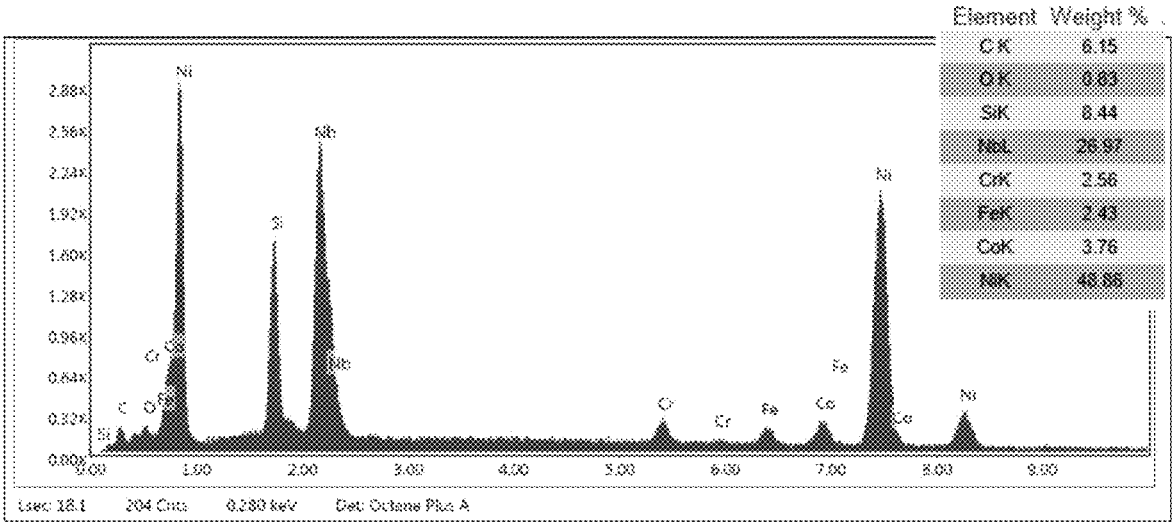
FIG. 4 shows an EDS analysis of Phase a in FIG. 3.

FIG. 4 is an EDS analysis of Phase a revealing 26.97/48.86 or approximately 0.55 Nb to Ni ratio in mass percentage.

Figure 5:
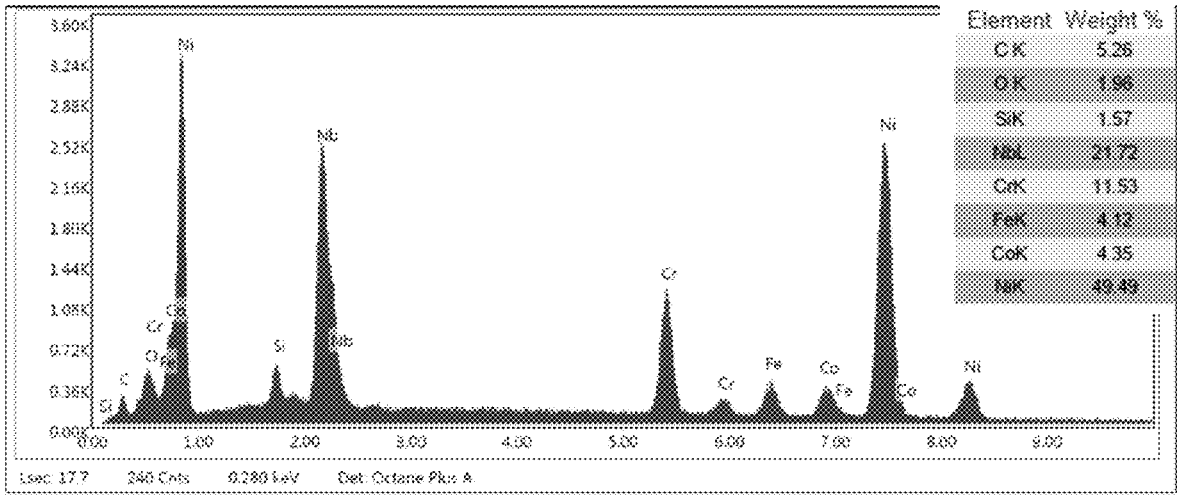
FIG. 5 shows an EDS analysis of Phase b in FIG. 3.

FIG. 5 is an EDS analysis of Phase b revealing 21.72/49.49 or approximately 0.44 Nb to Ni ratio in mass percentage.

Figure 6:
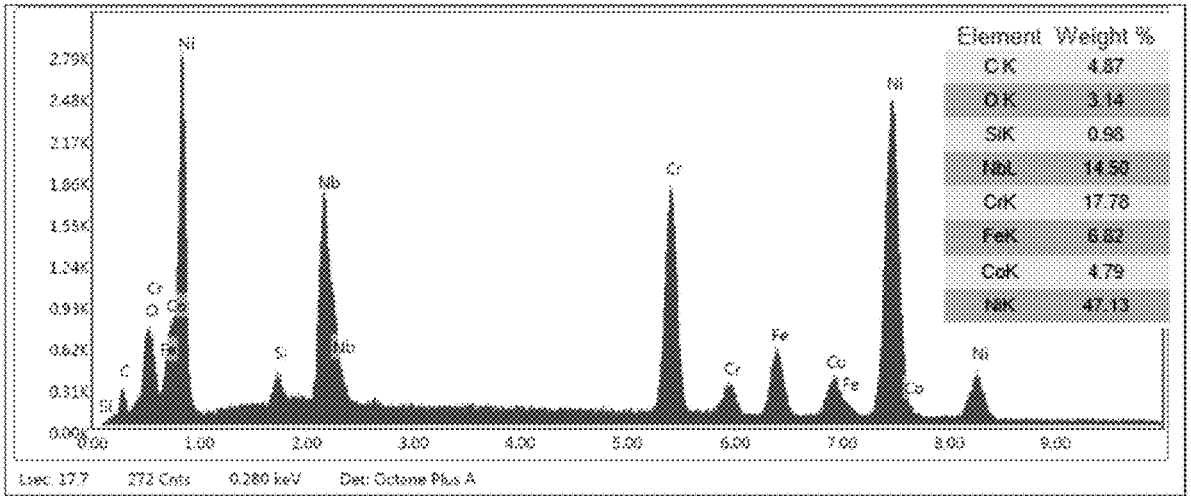
FIG. 6 shows an EDS analysis of Phase c in FIG. 3.

FIG. 6 is an EDS analysis of Phase c revealing approximately 0.31 Nb to Ni ratio.

Based upon the EDS analysis, a significant amount of rod like phases in Jonesite 19 (Phase a) is identified as $Ni_8Nb_7$ and another rod like phase (Phase c) is identified as $Ni_3Nb$. Phase b is located in the inter primary eutectic reactant region which possesses a Nb to Ni ratio of approximately 0.44.

Figure 7:
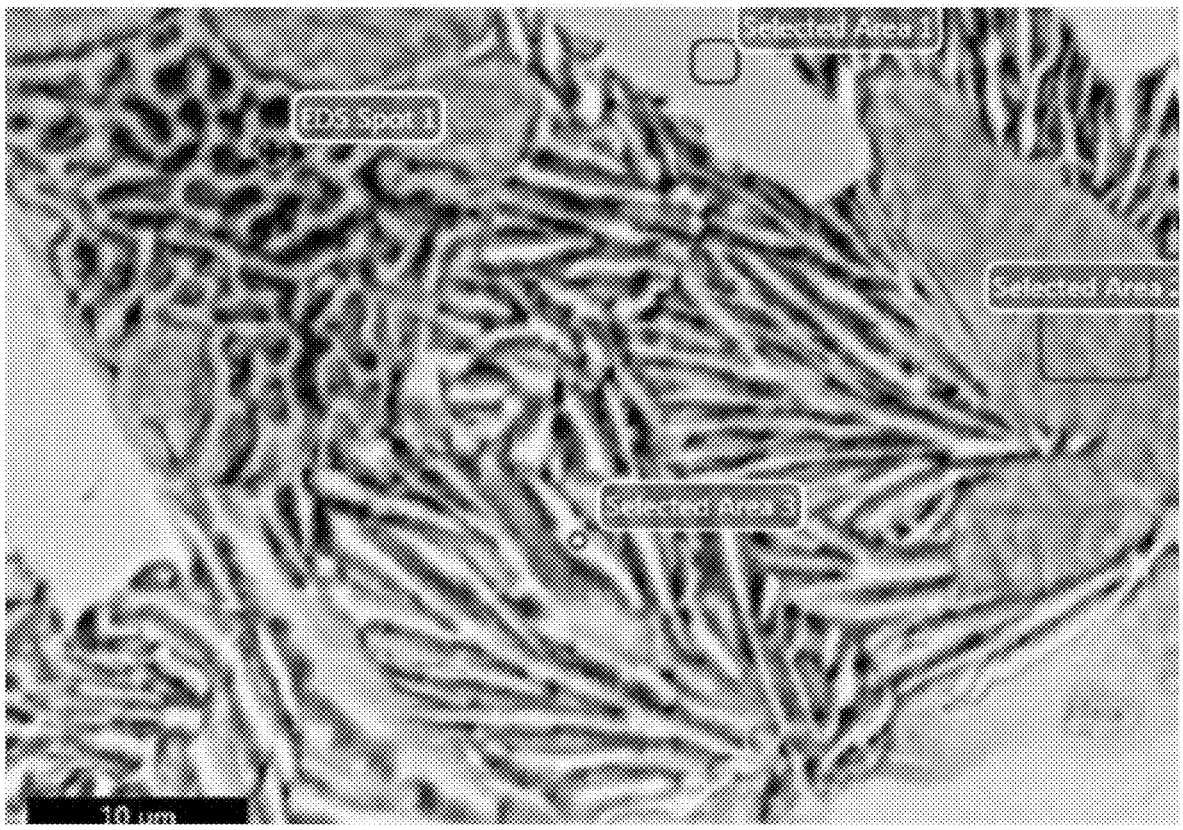
FIG. 7 shows an SEM image of inter primary eutectic reactants region at 5000×.

FIG. 7 shows a high magnification image of the inter primary eutectic reactants region. Clearly, besides the secondary eutectic reactants there are small amount of nickel solid solution phase (marked as Area 2). Thus, it can be reasonability assumed that the liquid remained after primary eutectic reaction was completed during the Jonesite solidification process, a nickel rich solid solution phase formed in the inter primary eutectic reactants region. Then, remaining liquid composition again reached to intermetallic-intermetallic eutectic reaction range after a nickel rich solid solution phase formed thus, a secondary eutectic reaction took place.

Figures 8A, 8B:
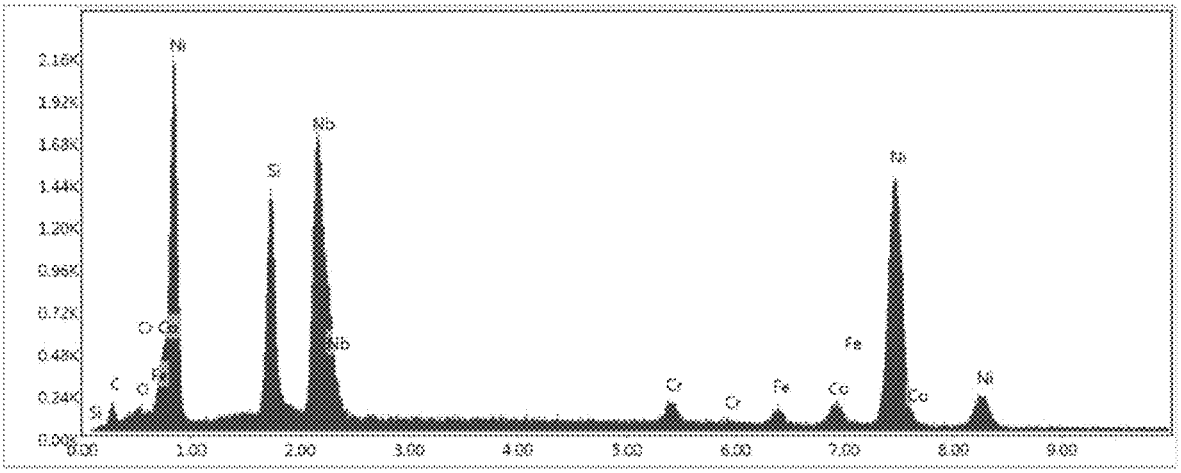
FIG. 8A shows an EDS analysis result for Spot 1 marked in FIG. 7
FIG. 8B shows the weight and atomic percentages.
Figures 9A, 9B:
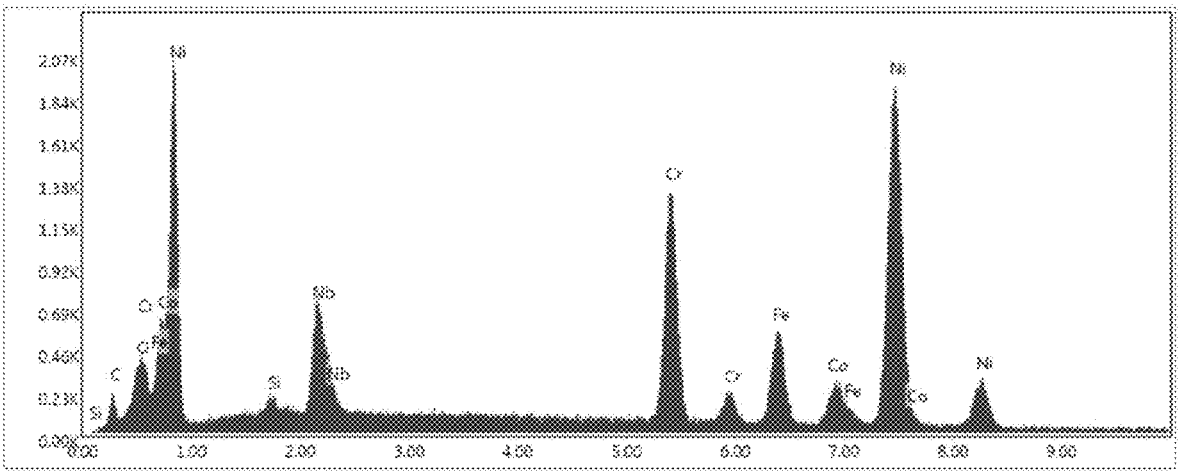
FIG. 9A shows an EDS analysis result for Area 2 marked in FIG. 7
FIG. 9B shows the weight and atomic percentages.
Figures 10A, 10B:
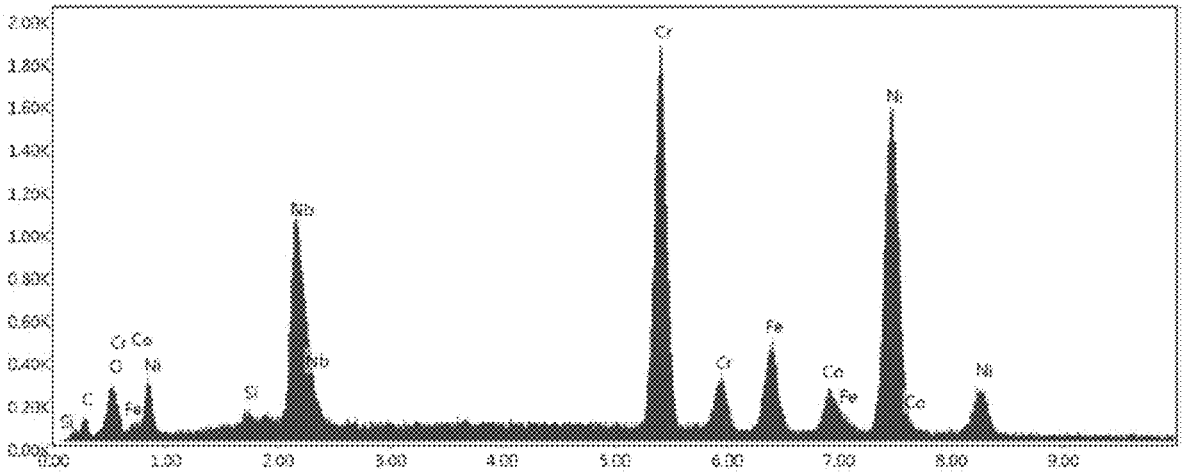
FIG. 10A shows an EDS analysis result for Area 3 marked in FIG. 7
FIG. 10B shows the weight and atomic percentages.

With respect to the areas marked in FIG. 7, FIG. 8A shows an EDS analysis result for Spot 1 marked in FIG. 7 and FIG. 8B shows the weight and atomic percentages; FIG. 9A shows an EDS analysis result for Area 2 marked in FIG. 7 and FIG. 9B shows the weight and atomic percentages; and FIG. 10A shows an EDS analysis result for Area 3 marked in FIG. 7 and FIG. 10B shows the weight and atomic percentages.

In view of the forgoing discussion, Jonesite 19 is expected to provide adequate hardness for engine components or other high temperature applications. Because the alloy is a "fully" intermetallic phase matric alloy, superior elevated temperature properties are expected. Simple sample etching tests revealed excellent corrosion resistance with such finely and uniformly distributed microstructure which has not been seen in any commercially available high temperature alloys. The lamella type of microstructure which can be formed through a solidification process rather than by powder metallurgy can provide another advantage to maximize the alloy application capabilities.

In general, Jonesite 19 can be considered a nickel-niobium intermetallic alloy containing, in weight percent, silicon from about 1.5 to about 3.5 percent; chromium from 5 to about 15 percent; nickel from about 45 to about 75 percent; niobium from about 14 to about 30 percent; cobalt up to about 7 percent; and iron up to about 10 percent; wherein the nickel plus niobium content is about 70 to about 90 percent and the total silicon, chromium, cobalt and iron content is about 10 to about 30 percent. For example, the alloy may contain about 0.01 to about 0.08 percent carbon, about 0.01 to about 0.2 percent manganese, about 1.9 to about 2.9 percent silicon, about 7 to about 15 percent chromium, about 0.01 to about 6.25 percent cobalt, about 0.05 to about 10 percent iron, about 14 to about 29 percent niobium, and about 48 to about 73 percent nickel.

The Jonesite 19 alloy may contain up to 3 percent other elements and incidental or unavoidable impurities including up to 0.1 percent carbon, up to 0.3 percent manganese, up to 0.5 percent molybdenum, up to 0.3 percent tungsten and up to 0.3 percent vanadium. If desired, the alloy can consist essentially of carbon, manganese, silicon, chromium, cobalt, iron, niobium and nickel and up to 3 percent total of other elements including phosphorus, sulfur, copper, nitrogen, oxygen, boron, tungsten, molybdenum, vanadium, tantalum, beryllium, titanium, hafnium, zirconium, aluminum, calcium, bismuth, lead, selenium, yttrium and rare earth metals.

In an embodiment, a valve seat insert or other part useful in a combustion engine can be made by casting the Jonesite 19 alloy. However, Jonesite 19 can be used to make other cast parts. Such parts can have a cast microstructure of at least 95 volume percent intermetallic phases and no more than about 5 volume percent solid solution phases. The intermetallic phases can include rod-like intermetallic phases of $Ni_3Nb$ and $Ni_8Nb_7$. The microstructure can be a lamellar microstructure and/or the microstructure can have less than 5 volume percent Ni—Fe and Ni—Co rich intermetallic phases. The casting of the alloy can be made by forming a melt of the alloy, pouring the melt into a mold and cooling the melt to form the casting. During cooling, the melt can be solidified into a microstructure of at least 95 volume percent intermetallic phases with a uniform microstructure.

Corrosion and hot corrosion resistance of alloys has become more and more important for IC engine component applications. For diesel and natural gas engines, the higher combustion temperatures is a current trend to enhance fuel economy while for hydrogen fueled IC engines, good corrosion/hot corrosion resistance is evidently a basic to ensure the desired engine performance.

Figure 11:
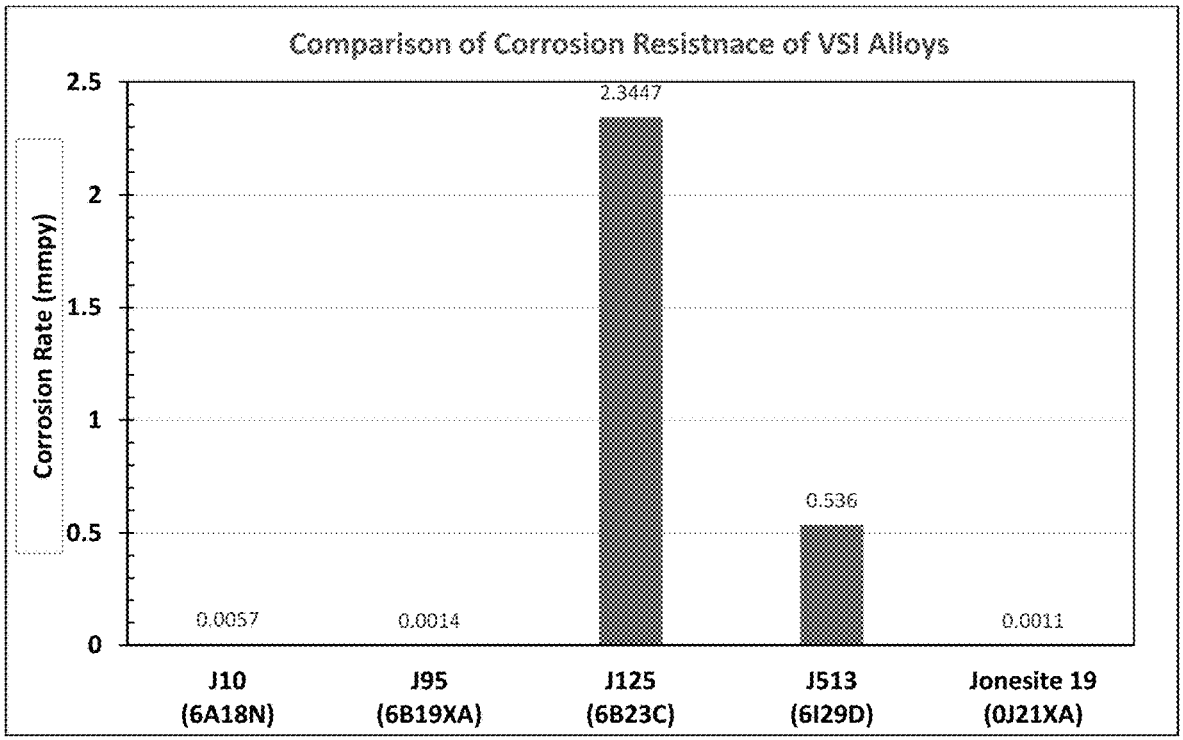
FIG. 11 shows a corrosion resistance comparison among different corrosion resistant alloys.

To compare Jonesite 19 to other alloys, a basic immersion corrosion resistance evaluation was carried out. The test applied includes an immerse test ring specimen in 500 ml solution with 3.4 vol. % of nitric acid, 1.4 vol. % of sulfuric acid and 1.65 g dissolved NaCl at 1.2 pH acidity level. The test duration is 168 hours. The corrosion rate was obtained by measuring mass change of the test specimen and average number of three tests is shown in FIG. 11 which shows a corrosion resistance comparison among different corrosion resistant alloys.

Compositions of the alloys involved in corrosion test is summarized in Table 2. Alloy J10 is a cobalt-based alloy with intermetallic strengthening phase. Alloy J95 is nickel rich alloy with fully eutectic solidification microstructure. Alloy J125 is a high carbon stainless steel. Alloy J513 is iron rich and has an intermetallic strengthened matrix. Alloy Jonesite 19 is an intermetallic-intermetallic cast composite.

TABLE 2

(composition of Jonesite 19 to LEJ alloys J10, J95, J125 and J513 for corrosion tests in wt. %).

| Element | J10 | J95 | J125 | J513 | Jonesite 19 |
|---|---|---|---|---|---|
| Carbon | 0.052 | 1.420 | 1.510 | 1.910 | 0.002 |
| Manganese | 0.049 | 0.194 | 0.488 | 0.316 | 0.004 |
| Silicon | 2.220 | 0.395 | 2.130 | 0.541 | 2.740 |
| Nickel | 0.227 | 37.450 | 1.160 | 2.040 | 51 |
| Chromium | 8.290 | 29.950 | 20.260 | 16.400 | 13.360 |
| Molybdenum | 28.310 | 8.160 | 0.102 | 12.360 | 0.323 |
| Tungsten | 0.224 | 14.640 | 0.094 | 1.480 | 0.205 |
| Vanadium | — | 0.060 | 0.103 | 0.044 | 0.222 |
| iron | 0.260 | 6.570 | 73.800 | 44.800 | 9.560 |
| Cobalt | 60.100 | 0.022 | 0.016 | 19.300 | 0.149 |
| Niobium | 0.069 | 0.034 | 0.052 | — | 21.53 |
| Others | Balance | Balance | Balance | Balance | Balance |

In general, an increase in chromium content can enhance corrosion resistance especially for iron-based or rich alloys. In the Jonesite intermetallic alloy system, even with a chromium content of 13.36 wt. %, the Jonesite 19 alloy possesses the highest corrosion resistance among these generally good corrosion resistant alloys.

Figure 12:
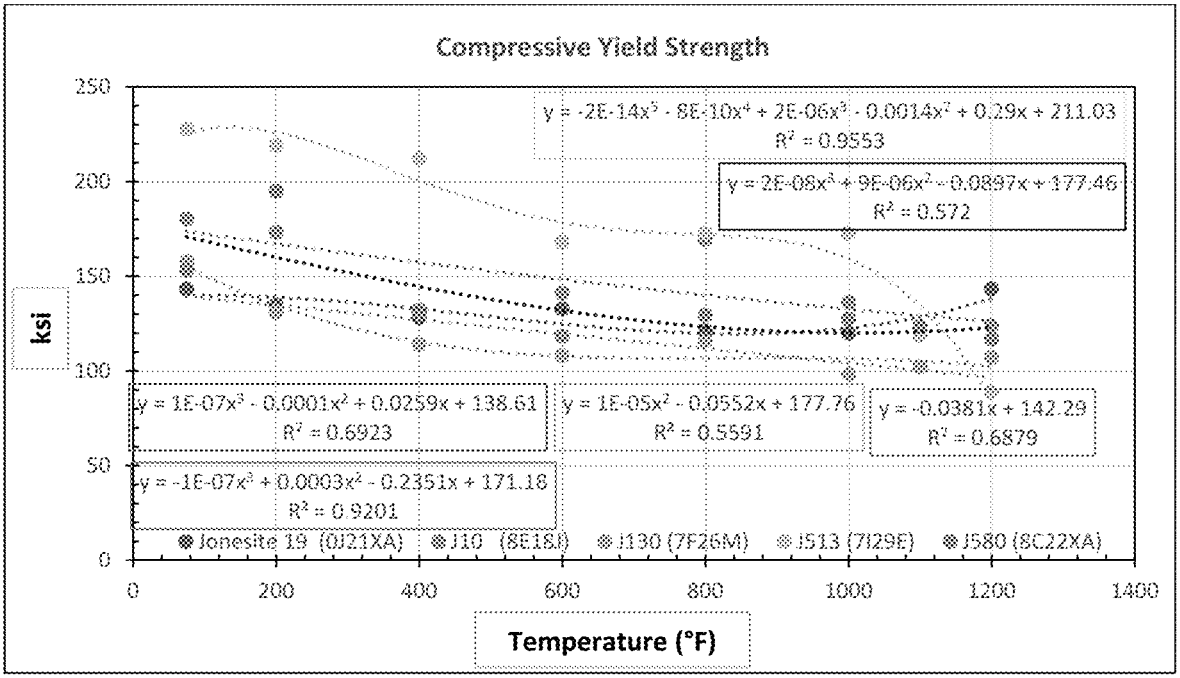
FIG. 12 shows compressive yield strength as a function of test temperature for five alloys evaluated.

The Jonesite 19 alloy has an intermetallic composite matrix and it is expected to exhibit a high compressive yield strength at elevated temperature. For a comparison purpose, several alloys with high compressive yield strengths are used for this study including LEJ alloys J10, J130, J513 and J580. Table 3 summarizes the test results of the compression testing while FIG. 12 shows the compressive yield strength as a function of test temperature for all five alloys evaluated.

TABLE 3

(comparison of compressive yield strength of Jonesite 19 compared to LEJ J10, J130, J513 and J580 high performance VSI alloys)

| Temperature (° F.) | Jonesite 19 | J10 | J130 | J513 | J580 |
|---|---|---|---|---|---|
| | 0.2% YS (ksi) | | | | |
| 75 | 143.2 | 180.1 | 157.7 | 227.8 | 153.0 |
| 200 | 134.7 | 173.0 | 131.1 | 218.8 | 194.7 |
| 400 | 128.1 | 132.1 | 113.7 | 212.3 | 131.1 |
| 600 | 132.7 | 141.0 | 107.9 | 167.8 | 118.4 |
| 800 | 121.2 | 169.5 | 115.9 | 172.6 | 129.4 |
| 1000 | 119.8 | 136.2 | 98.2 | 172.6 | 127.4 |
| 1100 | 122.1 | 118.8 | 102.1 | 119.2 | 123.4 |
| 1200 | 143.3 | 123.8 | 106.9 | 88.9 | 116.9 |

Most of the alloys studied showed a noticeable compressive yield strength reduction from ambient to 1200° F. However, the change in compressive yield strength as a function of test temperature of Jonesite 19 was the smallest compared to the other four alloys studied. In fact, the compressive yield strength at ambient was practically the same as that at 1200° F. for Jonesite 19. The materials property can be beneficial for engineering applications under an elevated temperature and/or with significant service temperature undulations during working conditions such as for diesel, natural gas, and hydrogen ICE engine components. As a result, Jonesite 19 is expected to have an excellent performance for VSI and/or other high temperature service components.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A nickel-niobium intermetallic alloy containing, in weight percent, silicon from about 1.5 to about 3.5 percent; chromium from 5 to about 15 percent; nickel from about 45 to about 75 percent; niobium from about 14 to about 30 percent; cobalt up to about 7 percent; and iron up to about 10 percent; wherein the nickel plus niobium content is about 70 to about 90 percent and the total silicon, chromium, cobalt and iron content is about 10 to about 30 percent, wherein the nickel-niobium intermetallic alloy has a microstructure of at least 95 volume percent intermetallic phases formed during solidification of a melt of the alloy.

2. The alloy of claim 1, further comprising up to 3 percent total other elements and incidental or unavoidable impurities including carbon, manganese, molybdenum, tungsten, vanadium, titanium, zirconium, hafnium, tantalum, beryllium, aluminum, boron, sulfur, phosphorus, copper, calcium, nitrogen, oxygen, selenium, lead, yttrium, rare earth metals, and bismuth.

3. The alloy of claim 1, further comprising up to 0.1 percent carbon, up to 0.2 percent manganese, up to 0.5 percent molybdenum, up to 0.3 percent tungsten, and up to 0.3 percent vanadium.

4. The alloy of claim 1, comprising about 1.75 to about 3 percent silicon.

5. The alloy of claim 1, comprising about 7 to about 15 percent chromium.

6. The alloy of claim 1, comprising up to about 6.5 percent cobalt.

7. The alloy of claim 1, comprising about 0.05 to about 10 percent iron.

8. The alloy of claim 1, comprising about 14 to about 29 percent niobium.

9. The alloy of claim 1, comprising about 48 to about 73 percent nickel.

10. The alloy of claim 1, consisting essentially of 1.75 to 3 percent silicon, 7 to 15 percent chromium, up to 6.5 percent cobalt, 0.05 to 10 percent iron, 14 to 29 percent niobium, 48 to 73 percent nickel, and balance up to 3 percent total unavoidable and incidental impurities.

11. The alloy of claim 10, wherein the unavoidable and incidental impurities include phosphorus, sulfur, copper, nitrogen, oxygen, boron, tungsten, molybdenum, vanadium, tantalum, beryllium, titanium, hafnium, zirconium, aluminum, calcium, bismuth, lead, selenium, yttrium and rare earth metals.

12. A valve seat insert, the valve seat insert made of the alloy of claim 1.

13. The valve seat insert of claim 12, wherein the valve seat insert is a cast valve seat insert.

14. A casting made of the alloy of claim 1, wherein the alloy has a cast microstructure of at least 95 volume percent intermetallic phases and no more than about 5 volume percent solid solution phases.

15. The casting of claim 14, wherein the intermetallic phases include rod-like intermetallic phases of $Ni_3Nb$ and $Ni_8Nb_7$.

16. The casting of claim 14, wherein the microstructure is a lamellar microstructure.

17. The casting of claim 14, wherein the microstructure has less than 5 volume percent Ni—Fe and Ni—Co rich intermetallic phases.

18. A method of casting the alloy of claim, 1, comprising forming a melt of the alloy, pouring the melt into a mold and cooling the melt to form the casting.

19. The method of claim 18, wherein during cooling the melt is solidified into a microstructure of at least 95 volume percent intermetallic phases with a uniform microstructure.

20. The method of claim 18, wherein the melt consists essentially of about 1.75 to about 3 percent silicon, about 7 to about 15 percent chromium, up to about 6.5 percent cobalt, about 0.05 to about 10 percent iron, about 14 to about 29 percent niobium, about 48 to about 73 percent nickel and balance up to 3 percent total other elements, with a total nickel plus niobium content of about 70 to about 90 percent and a total silicon, chromium, cobalt and iron content of about 10 to about 30 percent.

* * * * *